United States Patent [19]

Moser

[11] 4,227,288

[45] Oct. 14, 1980

[54] COMPACTOR SHOE CONSTRUCTION

[75] Inventor: Paul Moser, Harrington Park, N.J.

[73] Assignee: Compax Corp., Woodside, N.Y.

[21] Appl. No.: 930,346

[22] Filed: Aug. 2, 1978

[51] Int. Cl.[2] ..... D06C 21/00

[52] U.S. Cl. ..... 26/18.6

[58] Field of Search ..... 26/18.6; 162/280, 361

[56] References Cited

U.S. PATENT DOCUMENTS

| | | | |
|---|---|---|---|
| 1,861,424 | 5/1932 | Cluett | 26/18.6 |
| 1,992,194 | 2/1935 | Cluett | 26/18.6 |
| 3,015,145 | 1/1962 | Cohn et al. | 26/18.6 |
| 3,015,146 | 1/1962 | Cohn et al. | 26/18.6 |
| 3,083,435 | 4/1963 | Cohn et al. | 26/18.6 |
| 3,471,907 | 10/1969 | Beckers | 26/18.6 |
| 3,973,303 | 8/1976 | Diggle, Jr. | 26/18.6 |
| 4,156,955 | 6/1979 | Joy | 26/18.6 |

FOREIGN PATENT DOCUMENTS

| | | | |
|---|---|---|---|
| 494132 | 6/1950 | Belgium | 26/18.6 |
| 1110734 | 10/1955 | France | 26/18.6 |

*Primary Examiner*—Robert Mackey

[57] ABSTRACT

The disclosure is directed to mechanical compressive shrinkage apparatus of the type comprising opposed feeding and retarding rollers arranged for cooperation with a confining shoe. Fabric or the like is advanced over the feeding roller, being maintained in contact therewith by the confining shoe. The feeding and retarding rollers are arranged to form a nip, and the fabric enters this nip immediately after its emergence from between the feeding roller and the confining shoe. The retarding roller, moving at a slightly slower rate of speed than the feeding roller, and having a superior grip on the fabric, causes the fabric to be decelerated at the nip and mechanically compacted between the nip and the shoe. The disclosed improvements are directed specifically to the construction of the confining shoe itself, enabling manufacture of the shoe to be accomplished at significant savings and facilitating maintenance and repair of the shoe. The shoe assembly includes a rigid support beam, to which are secured a plurality of contoured shoe segments whose length is a fraction of the length of the rigid support beam. A thin, contoured, liner element is secured over the working faces of the shoe segments, forming a continuous, uninterrupted working surface arranged for contact with the fabric. The liner plate is arranged for easy replacement to accommodate wear.

4 Claims, 4 Drawing Figures

COMPACTOR SHOE CONSTRUCTION

BACKGROUND AND SUMMARY OF THE INVENTION

In the processing of many fabrics, including particularly but not limited to tubular knitted fabrics, it is advantageous to effect mechanical compressive shrinkage of the fabric as part of the finishing procedure, in order to compensate for the tendency of the fabric otherwise to shrink in the lengthwise direction as a result of normal washing and drying. Particularly advantageous equipment and procedures for this purpose are reflected generally in the Eugene Cohn et al. U.S. Pat. Nos. 3,015,145, 3,015,146 and 3,083,435. The Diggle U.S. Pat. No. 3,973,303 is directed to improved arrangements for operating and adjusting such equipment.

In general, mechanical compressive shrinkage of the type referred to includes a pair of feeding and retarding rollers arranged in opposed relation to form a nip through which fabric is directed. The respective feeding and retarding rollers are individually driven and controlled, such that the peripheral speed of the retarding roller is arranged to be less by predetermined amount than the peripheral speed of the feeding roller. A confining shoe is arranged for cooperation with the feeding roller such that incoming fabric is lightly urged against the surface of the feeding roller in order to provide a substantially positive feed of the fabric. Pursuant to known principles, the confining shoe terminates a short distance (e.g., six mm) upstream from the narrowest portion of the roller nip. In this short zone, the fabric undergoes a transition from its feeding speed, at the entry end of the zone, to its retarded speed, at the discharge end of the zone. The fabric is thus compressed lengthwise, under highly controlled conditions within the short zone, and then subjected to heat and rolling pressure as the fabric passes through the roller nip.

In the apparatus described, the confining shoe performs a critical function, and precise alignment and adjustment of the shoe is important. Moreover, the confining shoe has constituted a costly element of the equipment, because of the need for precise and complex contouring and shaping of the shoe over a rather substantial length. In the operation of the equipment, damage to the confining shoes is sometimes experienced as a result of careless operation, warpage of the shoe through uneven heating, etc. sometimes necessitating time consuming and expensive repair or replacement of the shoe.

In accordance with the present invention, a novel and improved confining shoe construction is provided which, at one time, enables a significant reduction in the initial manufacturing cost, improved operating performance, and greater convenience and facility in repair and maintenance. More particularly, in the apparatus of the invention, the confining shoe includes a heavy, rigid primary support beam arranged to extend over the full width of the machine. A plurality of individual, contoured shoe segments, are secured in side-by-side relation across the width of the beam and, collectively, provide a contoured surface corresponding substantially to the desired contours of the confining shoe. In conjunction with the several individual shoe segments, there is provided a single, continuous, contoured liner member, which conforms closely to the working contours of the shoe segments, and the outer surface of which forms the working surface of the confining shoe.

In the construction of a confining shoe in accordance with known techniques, it has been customary to mount at the extremity of the confining shoe a short, thin blade, which can extend between the feeding and retarding rollers, to a position close to but spaced a short distance from the working nip. In the confining shoe constructed in accordance with the present invention, the continuous, contoured liner element includes an integral portion, extending slightly beyond the extremities of the individual shoe segments and forming in effect the blade tip of the shoe.

Pursuant to the invention, the arrangement and mounting of the continuous liner element permits relatively easy removal and replacement of the liner, as may be necessary from time to time as the liner becomes worn or damaged.

In addition to realizing significant economies in initial manufacture and subsequent maintenance, the improved confining shoe construction enables a generally higher quality of production output to be achieved, because of the practical ability to maintain the equipment generally in better operating condition.

For a more complete understanding of the above and other features and advantages of the invention, reference should be made to the following detailed description of a preferred embodiment and to the accompanying drawings.

DESCRIPTION OF A PREFERRED EMBODIMENT OF THE INVENTION

Figure 1:
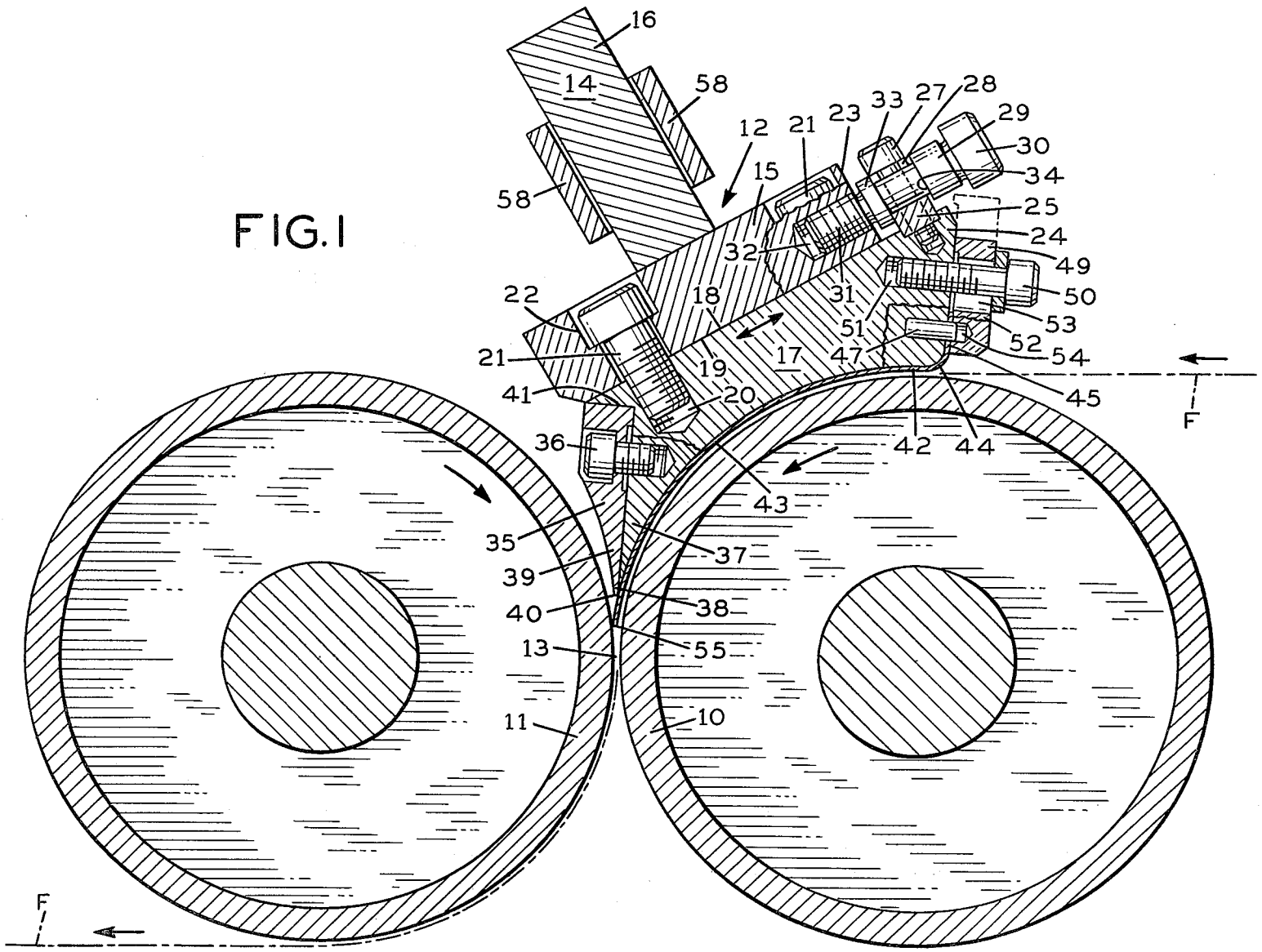
FIG. 1 is a cross sectional view of a longitudinal compressive shrinkage apparatus incorporating the features of the invention.

Referring now to the drawings, the reference numerals 10, 11 designate respectively feeding and retarding rollers of a longitudinal compressive shrinkage apparatus incorporating the general principles of the before mentioned earlier patents of Eugene Cohn et al. and Edmund Diggle. Reference may be had to the specifications of those patents, which may be regarded as being incorporated herein by reference.

Fabric F, advancing toward the compressive shrinkage apparatus is discharged onto the surface of the feeding roller 10. In accordance with known principles, the surface of the feeding roller is provided with a knurl or other appropriate roughness characteristic, enabling it to establish a gripping relationship with the fabric. A confining shoe assembly, designated generally by the reference numeral 12 and to be described in greater detail, is arranged in cooperative relationship with the feeding and retarding rollers 10, 11, extending across the full width of the machine. The confining shoe serves to guide, confine and apply light pressure to the fabric being advanced by the feeding roller 10.

In accordance with known principles, the confined feeding of the fabric F continues to a point slightly upstream of the roller nip 13, the nip being the line at which the rollers 10, 11 most closely approach each other. Typically, confined feeding of the fabric may be discontinued about six mm or so above the nip 13.

The retarding roller 11 is provided with a knurl or other surface characteristic which has a somewhat more effective gripping capability with respect to the fabric F than the surface of the feeding roller 10. Accordingly, as the fabric approaches the roller nip 13, and is being acted upon simultaneously by both rollers 10, 11, the roller 11 will assert a superior grip and control the advance of the fabric. The roller 11 is adjustably driven at a surface speed which is somewhat lower than that of the feeding roller 10, such that the fabric F is decelerated, as it approaches the nip 13, substantially to the surface speed of the retarding roller. Deceleration of the fabric is substantially confined to the short compressive shrinkage zone, between the end of the confining shoe 12 and the roller nip 13, and within this zone the fabric is compressed in a lengthwise direction. Typically, the fabric will have been steamed in advance of the compressive shrinkage station, and it is subjected to heat and rolling pressure at the nip 13, so that the compressive shrinkage action is retained in the finished fabric sufficiently to enable the fabric to be cut and sewed into garments and eventually to be washed and dried without excessive dimensional change.

As can be appreciated, uniform confinement of the fabric against the surface of the feeding roller 10, across the full width of the machine, is important to the achievement of uniform, high quality production results. Accordingly, a portion of the confining shoe which directly confronts the surface of the feeding roller must be accurately shaped. Heretofore, necessary machining and grinding to achieve this accurate shape has constituted a difficult and expensive part of the manufacturing procedure involved in the making of a compressive shrinkage apparatus of the type concerned. In addition, even after initially manufacturing the confining shoe to the precise contours required, there are sometimes problems in maintaining such contours, because of possible internal stresses in the materials of fabrication, which may become relieved over a period of time, and/or exposure of the equipment to uneven temperature conditions, causing warpage, etc. and, of course, if the equipment is carelessly operated, the precisely contoured shoe may become damaged necessitating premature replacement with a similar costly assembly.

In accordance with the present invention, a novel and improved confining shoe assembly 12 is provided, which is not only much more simple and economical to construct in the first instance, but which is more easily maintained both with regard to routine maintenance and with regard to major repair if that becomes necessary. The shoe construction of the invention, includes a rigid support beam 14, comprising a plate section 15, and a web section 16, arranged in inverted Tee-shaped configuration and extending continuously across the full width of the machine. The support beam 14 is mounted to be adjustable with respect to the feeding and retarding rollers 10, 11. For this purpose, mounting and adjusting arrangements of the general type illustrated in the Diggle U.S. Pat. No. 3,973,303 may be used to advantage.

Secured rigidly to the bottom surface of the supporting beam 14 are a plurality of contoured shoe segments 17, which are aligned in end-to-end fashion and extend across the full width of the supporting beam 14, or at least across the full working width of the machine. Desirably, the individual shoe segments 17 may be about 25 cm in length (measured transversely of the machine) and a typical machine of 1.25–1.5 meters in width would thus incorporate perhaps five or six such individual shoe segments 17 arranged end-to-end.

To greatest advantage, each of the shoe segments 17 is of identical construction and configuration, such that they may be repetitively manufactured on production machining equipment and easily interchanged. As reflected in FIG. 1, the shoe segmens 17 are provided with flat upper surfaces 18 arranged to seat against the flat lower surface 19 of the plate member 15 of the supporting beam. Each of the shoe segments 17 is provided with a plurality —four in the illustration—of threaded openings 20 for the reception of machine bolts 21. The bolts 21 are in turn received in recessed openings 22 formed in the beam plate 15. The recessed openings 22 in the plate 15 are somewhat larger in diameter than the corresponding diameter of the bolts 21, such that limited relative movement is permitted between the shoe segments 17 and the beam plate 15, to accommodate precision adjustment as will be hereinafter described.

Figure 4:
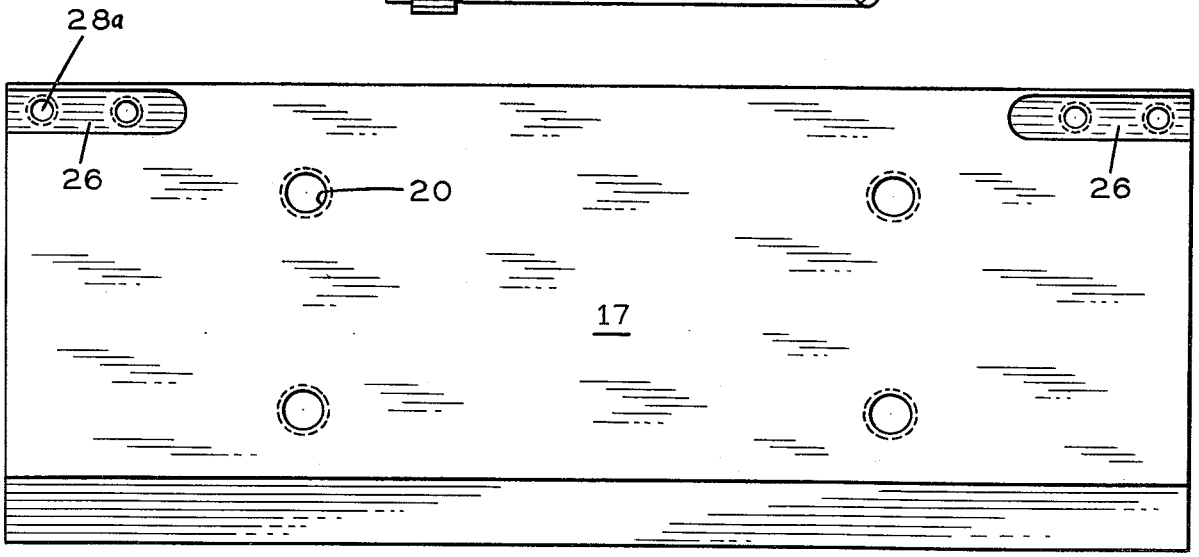
FIG. 4 is a top plan view of one of the shoe segments incorporated in the apparatus of FIG. 1.

As reflected in FIG. 1, a portion 24 of the shoe segments 17 extends beyond the edge of the beam plate 15 adjacent the upper side edge 23 of the plate. The projecting edge 24 of the shoe segment has secured thereto, adjacent each end of the shoe segment, a slotted yoke block 25. The yoke blocks advantageously are received in recesses 26 (FIG. 4) provided in the upper surfaces of the shoe segments, adjacent each end, and the yoke blocks are secured in place by pairs of bolts 27 received in threaded openings 28*a*. The yoke blocks 25 are provided with upwardly opening U-shaped slots 28, which slidably receive intermediate portions 29 of adjusting bolts 30. The adjusting bolts 30 have threaded portions 31 received in threaded bores 32 provided in the edge of the beam plate 15. In addition, the adjusting bolts 30 have opposed spaced flanges 33, 34 which straddle the yoke block 25.

During assembly of the shoe segments 17 to the beam plate 15, the individual segments are snugly but movably secured to the plate 15 by the plurality of bolts 21. The shoe segments are manipulated to be in tight end-to-end abutment. In addition, the positions of the shoe segments may be precisely adjusted in the direction of the plane of the upper surfaces of the segments, by careful manipulation of the adjusting screws 30, one at each end of each segment. The several segments are adjusted in this manner until a precise across-the-width alignment is achieved among the several segments. Thereafter, the bolts 21 may be further tightened to lock the shoe segments securely in their accurately adjusted positions.

Figure 2:
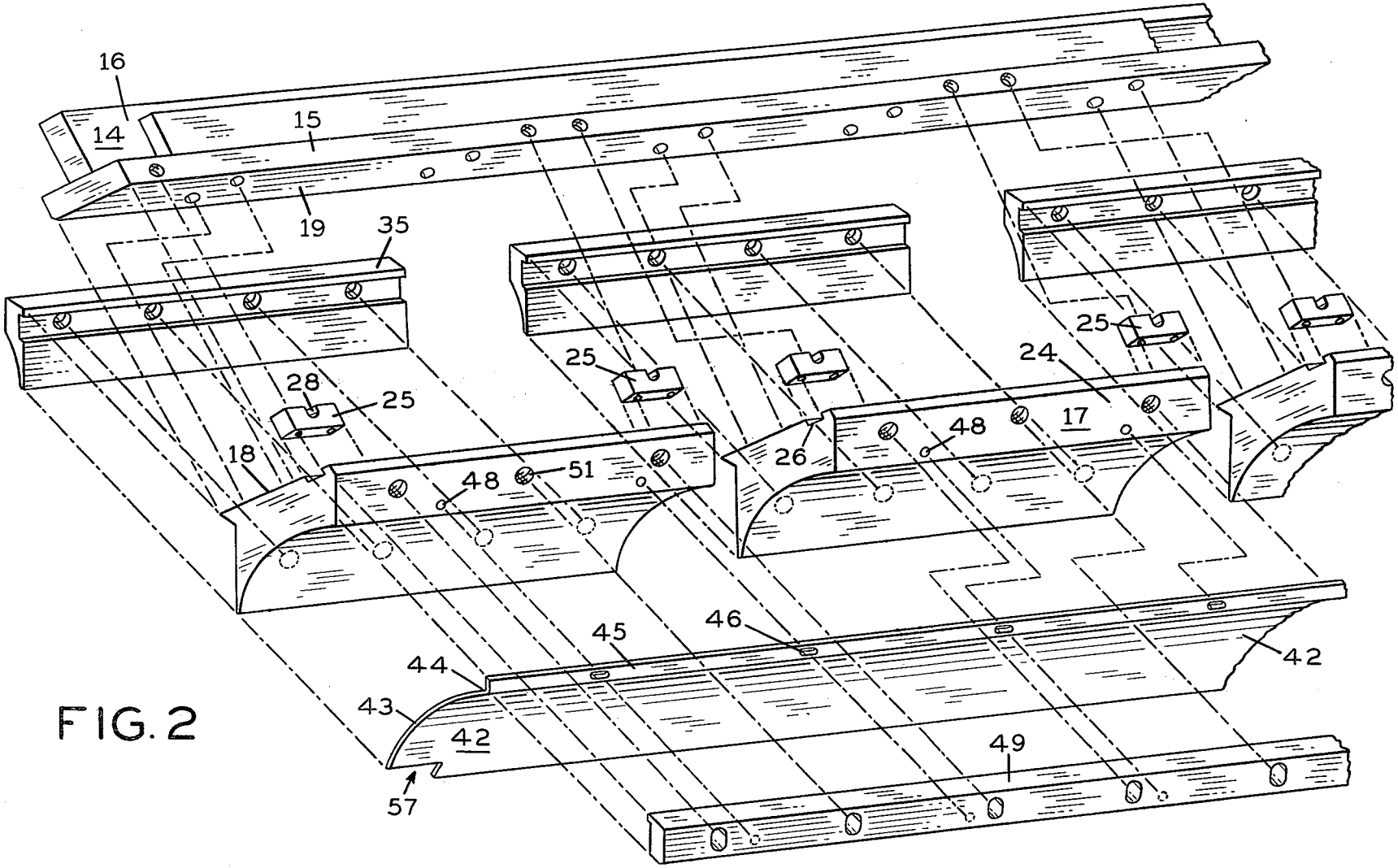
FIG. 2 is an exploded perspective view of the apparatus of FIG. 1 illustrating details of construction and assembly.
Figure 3:
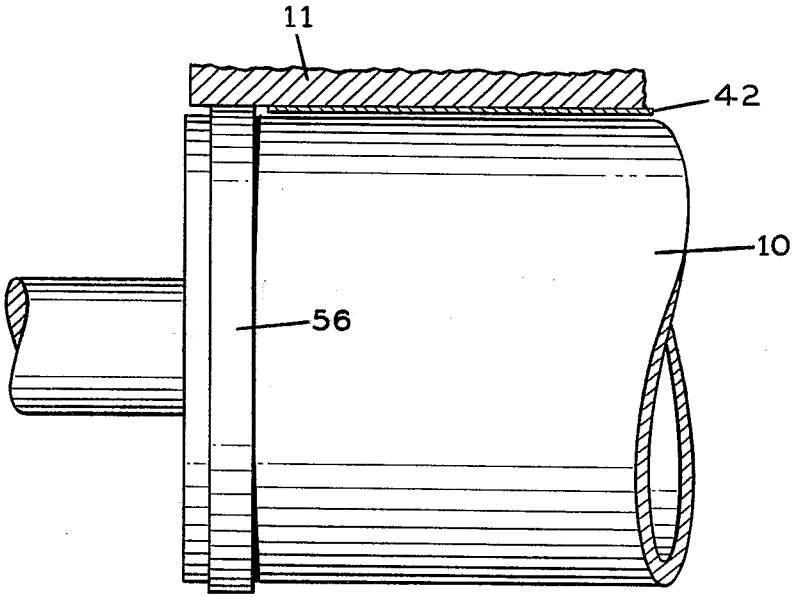
FIG. 3 is a fragmentary illustration of the roller nip area of the machine, showing the cooperative relationship of the working rolls and the shoe liner.

As shown in FIGS. 1 and 2, each shoe segment 17 includes a removable forward edge block 35, which is secured rigidly to the main body of the shoe segment by a plurality of bolts 36 and extends along the full length of the shoe segment. The forward lower portion 37 of the main shoe segment 17 tapers to a relatively fine, sharp tip 38 at its lower edge extremity. Likewise, the lower portion 39 of the edge block 35 tapers oppositely to a relatively fine tip 40. Typically, the tip 40 of the edge block 35 may be slightly more blunt than the tip 38 of the main shoe segment. The tapered edge block 35 thus serves as a replaceable guard for the fine trip extremity of the main shoe segment. Occasionally, through mishandling of the equipment or other malfunction, contact may result between the shoe assembly and the knurled or otherwise roughened surface of the retarding roller 11. When this happens, the fine edge or tip of the shoe assembly may be excessively worn or damaged. In the arrangement of the present invention, however, this may be easily repaired in a typical case by removal and replacement of the edge blocks 35.

To advantage, the edge blocks 35 may be arranged to be seated in a right angular recess 41 in the forward portion of the main shoe segment, in order to simplify and facilitate accurate alignment of the edge block 35 with respect to the main shoe segment 17.

Pursuant to the invention, the shoe segments 17 and edge blocks 35 are manufactured by precision duplication procedures, such that all of the segments are extremely uniform. After assembly and precision alignment of a series of such segments, a shoe assembly is provided which is of uniform surface contour and characteristics throughout, except for slight discontinuities at the edge to edge joints of adjacent, aligned shoe segments.

Regardless of the precision with which adjacent shoe segments are assembled and aligned, the edge joint between segments will present a discontinuity, which could result in marking of the fabric. Accordingly, pursuant to the invention, a continuous, contoured confining shoe surface is provided by means of a pre-contoured continuous liner element 42. The liner element extends for the full working width of the shoe assembly and includes an arcuately contoured portion 43, closely following the arcuate lower contours of the shoe segments. The continuous liner advantageously is formed of a material such as beryllium copper of about 24 gage material, corresponding to a thickness of about 0.51 mm.

At its upstream or entry-side edge, the liner 42 has a short radius curve 44 leading to an upwardly extending mounting flange 45. The mounting flange 45 is provided across its width with a plurality of laterally elongated openings 46 adapted for the reception of locating pins 47 (FIG. 1). A pair of such pins are mounted in openings 48 (FIG. 2) provided therefor in the several shoe segments 17. The continuous liner 42 is secured in position on the assembled shoe segments 17 by means of an elongated clamping bar 49 arranged to extend along the upstream face 24 of the shoe segments. The clamping bar is secured to the shoe segments by means of bolts 50 engaged in threaded bores 51 in the several shoe segments. The lower margin 52 of the clamping bar is arranged to overlie the mounting flange 45 of the continuous liner, enabling the liner to be tightly clamped to the assembled shoes, when the bolts 50 are tightened down on the clamping bar.

Because of the relatively high coefficient of expansion of the beryllium copper, it is usually desirable to bring the equipment up to operating temperature before securing the clamping bar 49. The elongated openings 46 accommodate the necessary relative expansion of the liner 42 during the warm up phase. Desirably, the bolts 50 are received in vertically elongated slots 53 in the clamping bar, such that the clamping bar need not be removed entirely from the assembly to permit replacement of the liner 42. By loosening the several clamping bolts 50, lifting the clamping bar to the limit of the elongated openings 53, and then snugly retightening one or two of the bolts, the clamping bar is temporarily held in an upraised position, as indicated by phantom lines in FIG. 1. This is sufficient to permit removal and replacement of a liner sheet 42. When the clamping bar is inactive, the liner is suspended and located by means of the several pins 47. These pins are received in recesses 54 in the clamping bar when the bar is returned to its clamping position, as illustrated in full lines in FIG. 1.

In accordance with one aspect of the invention, the length, measured circumferentially, of the arcuate portion 43 of the continuous liner is such that the lower or downstream extremity of the liner projects somewhat below the edge extremities 38, 40 of the shoe segments 17 and associated edge blocks 35. Typically, the liner might project about six mm below the tip portions 38, 40. The lower edge extremity 55 of the liner thus defines the upstream end of a fabric compacting zone, in accordance with otherwise generally known principles. In a typical adjustment of the equipment, the liner edge 55 may be located approximately five mm upstream from the roller nip, although it is to be understood, of course, that the specific adjustment of the length of the compressive shrinkage zone may vary somewhat in accordance with the nature of the material being processed and the desired processing results.

In typical operating adjustment, the lower edge region of the continuous liner may bear against the surface of the retarding roller 11, possibly as a function of machine adjustment alone, but also partly as a result of the presence, in the small gap between the liner and the surface of the feeding roller 10 of the fabric being processed. A certain amount of wear is, of course, occasioned by such contact, and in a high capacity production line, the operating life of the liner may be on the order of, for example, seven days of production. With the arrangement of the invention, the liner may be quickly and inexpensively replaced, resulting in restoration to original condition not only of the edge 55, but also in effect fully reconditioning the arcuate working surface of the shoe assembly.

Although it is advantageous to pre-contour the continuous liner 42 to rather closely follow the contour of the shoe segments 17, precision forming of the liner is by no means vital. The liner is both thin and flexible, and easily deforms under typical, modest working pressures in order to conform fully to and be supported over its full surface by the assembled shoe segments.

In a typical compressive shrinkage installation of the general type herein described, it is advantageous to provide, at each end of the feed roller 10, guard rings 56 of slightly greater overall diameter than the feed roller 10, arranged to make initial contact with the retarding roller 11 and thereby prevent direct contact between the two rollers, which would of course result in damage to one or both, because of differential operating surface speeds. In a typical installation, a minimum clearance of about 0.3 mm. may be provided by the guard rings 56. Desirably, the continuous liner 42 may extend into somewhat overlapping relation with the guard ring 56. Accordingly, the opposite edge extremities of the liner are notched out, as shown at 57 in FIG. 2 to accommodate the presence of the guard rings.

In accordance with known practices, the shoe assembly 12 is maintained at an elevated temperature during normal operation of the equipment. To this end, electrical heater strips 58 may be mounted on the web section 16 of the supporting beam. The heating strips serve to conductively heat the shoe assembly as a whole in an appropriate manner.

The improved form of confining shoe assembly incorporates a number of significant advantages over known designs. By constructing the contoured portion of the shoe in a series of relatively short segments, important practical economies can be realized in the manufacturing process. The smaller segments are more readily accommodated in machining equipment of modest size and are thus more adaptable to precision manufacture. Moreover, if a segment proves to be defective, by reason of off-specification material or operator error, the production loss of an individual segment is significantly less than is the case with a unitary, full-width shoe member. The problems involved with warpage, for example, are also enormously minimized. In an elongated, unitary shoe element, even a small amount of warpage may ruin the unit, because of the cumulative effects over the full length. In the arrangement of the present invention, however, warpage problems are minimized by the shorter length of the segments, and individual precision adjustment of the segments may permit compensatory adjustment to be made.

Multiple advantages are derived from the provision in the assembly of a continuous, replaceable liner. One such advantage derives from the fact that the fabric being processed faces an uninterrupted working surface over the entire circumferential length of the shoe assembly. Heretofore, even where the shoe has been manufactured as a unitary element, the fine tip or extremity of the shoe assembly has been formed of a replaceable blade, in order to accommodate the relatively high rate of wear in this area. Thus, in machines of prior construction, there is at least a slight discontinuity in the working surface at the line where the shoe body terminates and the short blade tip commences.

An additional important advantage of the present construction resides in the fact that the continuous liner element, which is easily formed and relatively inexpensive, can be replaced with a relatively high degree of frequency at minimum cost of material and labor and minimum interruption of processing continuity. Each time the continuous liner is replaced, not only is the fast wearing extremity or blade tip renewed, but the entire working surface of the shoe surface of the shoe assembly is completely renewed. This has important ramifications, because it is easy for the working surface of the shoe assembly to become marred during utilization, such as by the undetected conveyance of foreign matter in or on the fabric being processed. In this respect, a slight scratch on the surface of the confining shoe may result in a noticeable marking of the processed fabric, requiring reconditioning of the surface. With the equipment of the present invention, a complete reconditioning of the surface is a matter of merely changing the continuous liner, with but a slight interruption in the processing activity.

As will be appreciated by those familiar with the art, the shoe assembly incorporating all the features of the invention may readily be constructed to a configuration corresponding to that of the more conventional shoe assemblies of existing equipment. Thus, equipment already in the field may be readily converted to include a shoe assembly of the new design, by a relatively straightforward substitution of one shoe assembly for the other.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. In a mechanical compressive shrinkage apparatus of the type comprising, (a) feeding and retarding rollers arranged in opposed relation and forming a working nip, (b) a confining shoe having roll-confronting surface portions cooperating with said feeding roller and tip portions located upstream of said working nip, the improvement in said confining shoe characterized by (c) a rigid supporting beam extending continuously across the full effective working width of the feeding and retarding rollers in a region generally opposite said working nip, (d) a plurality of confining shoe segments secured individually to said supporting beam in end-to-end alignment, (e) a continuous liner element extending over the full working width of the aligned shoe segments, (f) said liner being formed of thin, conformable sheet material and being pre-contoured to conform generally to the contours of the roll-conforming surface portions of the shoe segments, (g) said continuous liner extending in a circumferential direction over the full confronting surface areas of the shoe segments and projecting beyond said tip portions to form a working edge located between said nip and said tip portions, (h) said continuous liner element being secured at its upstream edge, (i) said liner having an unsecured portion extending downstream from its secured edge, between said feeding roller and said shoe segments, (j) said rigid shoe-supporting beam being of generally inverted Tee-shaped cross section, including a plate section and an upwardly extending web section, (k) said plurality of said shoe segments being secured individually to said plate section, (l) means for adjusting said shoe segments independently with respect to said plate section, (m) said continuous liner having, adjacent its upstream edge, an upturned flange portion overlying the upstream side edge regions of said shoe segments, and (n) means securing said flange portion to said side edge regions.

2. A mechanical compressive shrinkage apparatus according to claim 1, further characterized by (a) said continuous liner element being secured to said shoe segments exclusively by said upturned flange portion.

3. A mechanical compressive shrinkage apparatus according to claim 1, further characterized by (a) cooperating locating pins on said shoe segments and openings on said upturned flange, for locating and temporarily supporting said continuous liner on said shoe segments, and (b) a clamping bar secured to said shoe segments for clamping said continuous liner to said shoe segments.

4. In a mechanical compressive shrinkage apparatus of the type comprising, (a) feeding and retarding rollers arranged in opposed relation and forming a working nip, (b) a confining shoe having roll-confronting surface portions cooperating with said feeding roller and tip portions located upstream of said working nip, the improvement in said confining shoe characterized by (c) a rigid supporting beam extending continuously across the full effective working width of the feeding and retarding rollers in a region generally opposite said working nip, (d) a plurality of confining shoe segments secured individually to said supporting beam in end-to-end alignment, (e) a continuous liner element extending over the full working width of the aligned shoe segments, (f) said liner being formed of thin, conformable sheet material and being pre-contoured to conform generally to the contours of the roll-confronting surface portions of the shoe segments, (g) said continuous liner extending in a circumferential direction over the full confronting surface areas of the shoe segments and projecting beyond said tip portions to form a working edge located between said nip and said tip portions, (h) a plurality of adjusting screws connecting said shoe segments individually with said supporting beam, (i) said adjusting screws being individually adjustable to effect precision across-the-width alignment of a plurality of said shoe segments, and (j) mounting bolts, independent of said adjusting screws, for securely locking said shoe segments to said supporting beam.

* * * * *